United States Patent [19]

Lind

[11] 4,180,909

[45] Jan. 1, 1980

[54] KNIFE WITH EXCHANGEABLE BLADES

[76] Inventor: Anders Lind, Skolvägen 12, S-792 00 Mora, Sweden

[21] Appl. No.: 886,375

[22] Filed: Mar. 14, 1978

[51] Int. Cl.[2] ..... B26B 1/00

[52] U.S. Cl. ..... 30/332; 30/336; 30/338

[58] Field of Search ..... 30/332, 333, 336, 338

[56] References Cited

U.S. PATENT DOCUMENTS

| | | | |
|---|---|---|---|
| 430,186 | 6/1890 | Johnson | 30/336 |
| 1,064,101 | 6/1913 | Smith | 30/332 |
| 1,257,179 | 2/1918 | Berst | 30/338 |
| 1,506,897 | 9/1924 | Goldman | 30/332 |
| 1,861,363 | 5/1932 | Scheuner | 30/338 |
| 1,874,740 | 8/1932 | Green | 30/338 |
| 1,951,393 | 3/1934 | Castroviejo | 30/336 |
| 2,707,830 | 5/1955 | McColl | 30/336 |
| 2,736,964 | 3/1956 | Lieberman | 30/336 |

FOREIGN PATENT DOCUMENTS

| | | | |
|---|---|---|---|
| 177344 | 3/1922 | United Kingdom | 30/344 |

*Primary Examiner*—Othell M. Simpson
*Assistant Examiner*—J. T. Zatarga
*Attorney, Agent, or Firm*—Sughrue, Rothwell, Mion, Zinn and Macpeak

[57] ABSTRACT

A knife comprises a tension rod insertable into an opening extending through a handle, and a bolt at one end of the handle and in threaded engagement with the tension rod for retaining a replaceable blade at the other end of the handle. The tension rod comprises two elongate parallel rod portions of rigid material, one of which is provided with pins engageable with holes in the blade for retaining the blade between adjacent ends of the rod portions. These ends of the rod portions are formed with at least one wedge surface for co-operation with a corresponding wedge surface on the handle. This knife construction facilitates cleaning, requires few parts and enables the blade and the tension rod to be readily withdrawn from the handle.

4 Claims, 5 Drawing Figures

KNIFE WITH EXCHANGEABLE BLADES

The present invention relates to a knife, and more particularly to a knife having a readily replaceable blade.

Such knives are advantageously employed in hunting and fishing, in butcheries and in the fish processing industry. In that industry, it is an important requirement that knives should be readily and carefully cleaned.

According to the present invention, there is provided a knife comprising a handle having an opening extending through the handle; a replaceable blade; a tension rod insertable into the opening; means for drawing the tension rod towards the one end of the handle for retaining the blade at the opposite end of the handle; the tension rod comprising two elongate parallel rod portions of rigid material and pins engageable in holes in the blade for retaining the blade directly between adjacent ends of the rod portions; the ends of the rod portions being provided with at least one wedge surface for co-operation with a corresponding wedge surface on the opposite end of the handle.

With the present knife, both the blade and also its tension rod can be very easily removed from the handle merely by releasing the drawing means co-operating with the tension rod, whereupon the blade and the tension rod can be pulled from the opposite end of the handle. Since the tension rod is formed in two portions, all surfaces thereof are easily accessible for cleaning. Also, from the manufacturing point of view, the knife is very advantageous, since it comprises a minimum number of parts and has no joints.

In a preferred embodiment of the present invention, the wedge surfaces are conically curved, which provides a very good seal between the tension rod and the handle. Preferably, two of the pins are provided on one of the rod portions, and two corresponding holes are provided in the other of the rod portions, the two rod portions being formed with support surfaces for abutment with an upper edge of the blade. With this construction, a very rigid gripping of the knife blade in the tension rod extending through the handle is obtained. When a loading is exerted on the blade, there is not direct abutment between the blade and the handle; moreover, all forces are taken up by the tension rod.

It has also been found advantageous, in a knife embodying the invention, for the blade to be easily replaced, when it has lost its sharpness, by a sharp blade. If required, it can first be turned around, so that the two ends of the blade can be used in succession. The blunt blade can then be sharpened while the handle is used with new blades. Moreover, the knife handle does not need to be thrown away when a blade is used up, i.e. has been sharpened as many times as possible. The same handle may also be employed for different types of blades, whereby there is provided a combination tool.

The invention will be more readily understood from the following description of a preferred embodiment thereof, given by way of example, with reference to the accompanying drawings, in which.

Figure 1:
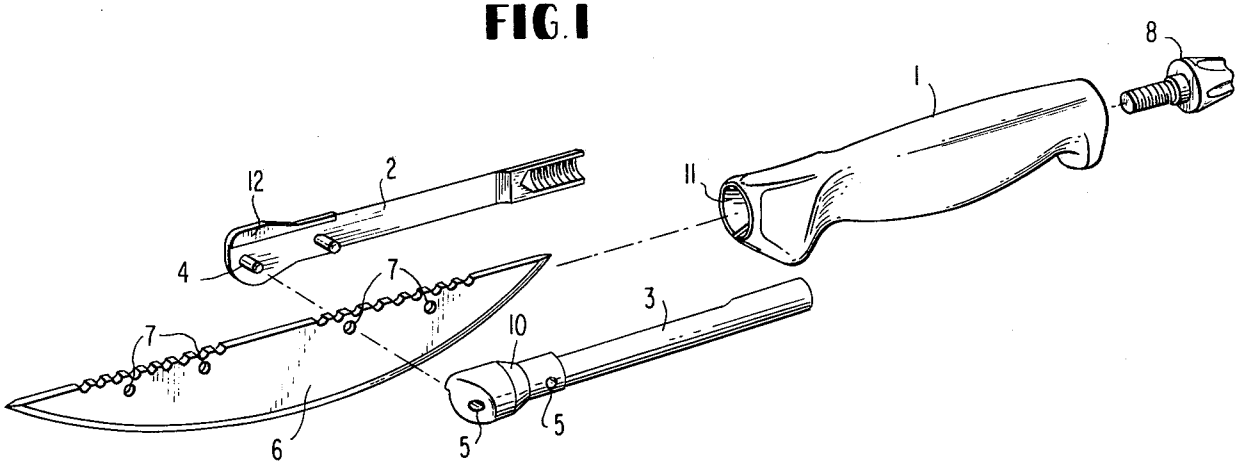
FIG. 1 shows a view taken in perspective of parts of a knife in unassembled relationship.
Figure 2:
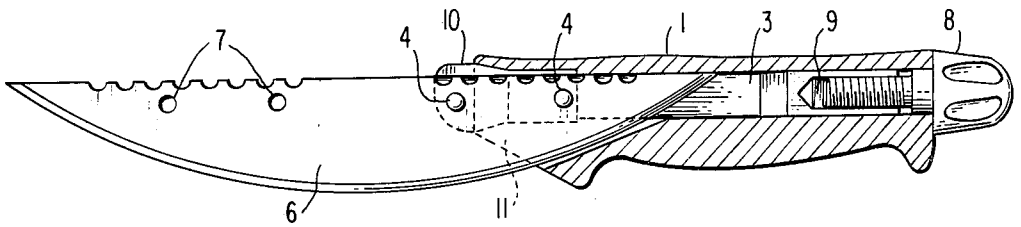
FIG. 2 shows a view taken in longitudinal section through the knife of FIG. 1 when assembled.

The knife shown in FIGS. 1 and 2 comprises a handle 1 provided with an opening extending therethrough, and a tension rod arranged in the handle and comprising two longitudinal parallel rod portions 2 and 3. The rod portion 2 is provided with two pins 4, and the other rod portion 3 has corresponding holes 5. A knife blade 6 is provided at each of its opposite ends with two holes 7 corresponding to the pins 4. At the rear end of the handle, there is arranged a bolt 8 which co-operates with a recess 9 provided with an internal thread at the rear part of the tension rod. The rod portions 2 and 3 are each provided with an enlarged front end portion having a wedge surface 10, these wedge surfaces being conically curved and together forming a conical surface which co-operates with a corresponding surface at the mouth of the opening extending through the handle. This conical surface is interrupted only by a slot 11 for receiving the blade 6. Moreover, the above-mentioned enlarged end portions are formed with support noses 12, which co-operate with the upper edge surface of the blade 6.

Upon engagement of the blade 6 in the handle 1, one end of the blade is inserted between the rod portions 2 and 3, so that the pins 4 extend through the holes 7 in the blade and project into the holes 5 in the rod portion 3. The tension rod, together with the blade, is then slid into the handle 1. Upon tightening of the bolt 8 in the threaded recess 9, the tension rod is drawn rearwardly into the handle, whereby the conically curved surfaces 10 of the tension rod are brought into sealing abutment against the surface of the conical wedging opening at the front end of the handle. In this way, there is provided a very good seal between the tension rod and the handle and a very stable engagement of the knife blade. The forces acting on the blade are transmitted through the pins 4 and the support noses 12 directly to the tension rod, which is firmly engaged in the handle, and because of the encircling abutment of the conically curved surfaces 10 of the tension rod and the opening in the handle 1, there is no direct contact between the blade and the handle.

The conically curved surfaces are formed with a conical angle such that no appreciable fixed wedging is produced upon the fixed securement of the blade in the handle. The blade can therefore be very readily released merely by untightening the bolt 8, whereupon the cutter blade can be drawn forwardly, together with the tension rod, from the handle. This, and the easy accessibility to all surfaces, as mentioned hereinbefore, considerably facilitates cleaning of the knife.

The openings 7 at the front of the knife blade allow the blade to be reversed when the front end of the blade has become blunt. The simple engagement of the blade in the handle also enables different types of blades to be employed with one and the same handle, so that the knife serves as a combination tool.

Figure 3:
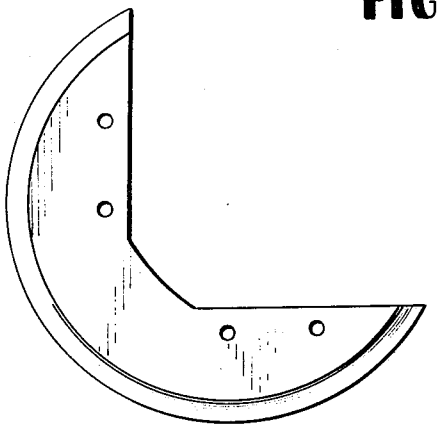
FIGS. 3 to 5 illustrate alternative types of blades.
Figure 4:
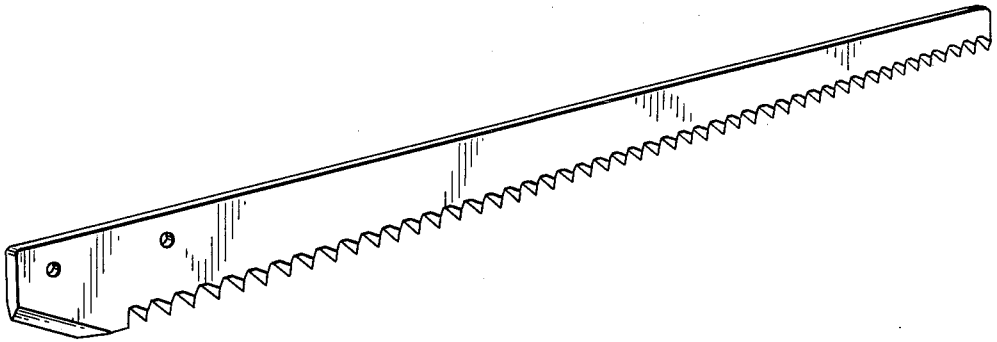
Figure 5:
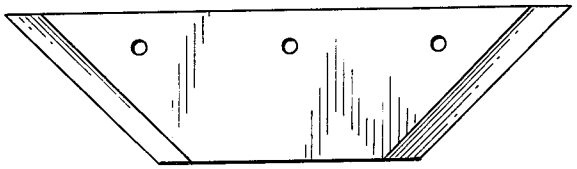

FIGS. 3 to 5 show different examples of alternative blade types which can all be fixedly secured in the handle of the knife illustrated in FIGS. 1 and 2. The blade illustrated in FIG. 3 is suitable for cutting meat; the blade shown in FIG. 4 is suitable for sawing bones and that shown in FIG. 5 is suitable for cutting carpets and the like.

The embodiments of the invention in which an exclusive property or privilege is claimed are defined as follows:

1. A knife, comprising:

a handle having an opening extending through said handle, the inside surface of said handle in a region adjacent said opening having a wedge surface and said handle having a single slot extending longitudinally from said opening for receiving a blade;

a replaceable blade having a plurality of spaced holes therein;

a tension rod insertable into said opening;

means for drawing said tension rod towards the one end of said handle for retaining said blade at the opposite end of said handle;

said tension rod comprising two elongate parallel rod portions of rigid material and pins extending laterally from at least one of said rods and being engageable in said holes in said blade for retaining said blade directly between adjacent ends of said rod portions, said rod portions comprising support surfaces for abutment with an upper edge of said blade;

said ends of said rod portions being provided with at least one wedge surface for co-operation with said wedge surface on said handle and said blade extending sufficiently far into said handle to be rigidly secured therein.

2. A knife as claimed in claim 1, wherein said wedge surfaces are conically curved.

3. A knife as claimed in claim 1, wherein two of said pins are provided on one of said rod portions, and two corresponding holes are provided in the other of said rod portions.

4. A knife as claimed in claim 1, 2 or 3, wherein said tension rod is dimensioned to fit into said handle opening without appreciable play and said rod portions are shaped at the opposite ends thereof to define a threaded recess, said drawing means comprising a bolt for threaded engagement in said recess and for abutment with said one end of said handle.

* * * * *